US005362944A

United States Patent [19]

Hatanaka et al.

[11] Patent Number: 5,362,944

[45] Date of Patent: Nov. 8, 1994

[54] GLOW PLUG WITH DUAL, DISSIMILAR RESISTIVE HEATING ELEMENTS IN CERAMIC HEATER

[75] Inventors: Koji Hatanaka; Takashi Aota, both of Saitama, Japan

[73] Assignee: Jidosha Kiki Co., Ltd., Tokyo, Japan

[21] Appl. No.: 42,833

[22] Filed: Apr. 5, 1993

Related U.S. Application Data

[63] Continuation of Ser. No. 816,352, Dec. 30, 1991, abandoned.

[30] Foreign Application Priority Data

Feb. 6, 1991 [JP] Japan ..... 3-035128

[51] Int. Cl.[5] ..... H05B 3/18

[52] U.S. Cl. ..... 219/270

[58] Field of Search ..... 219/260–270, 219/553, 544, 552; 361/264–268; 123/145 R, 145 A

[56] References Cited

U.S. PATENT DOCUMENTS

| | | | |
|---|---|---|---|
| 4,650,963 | 3/1987 | Yokoi | 219/270 |
| 4,682,008 | 7/1987 | Masaka | 219/270 |
| 4,914,751 | 4/1990 | Masaka et al. | 219/270 |
| 5,086,210 | 2/1992 | Nunogaki et al. | 219/270 |

FOREIGN PATENT DOCUMENTS

| | | | |
|---|---|---|---|
| 335382 | 10/1989 | European Pat. Off. | 219/270 |
| 58-110919 | 7/1983 | Japan | 219/270 |
| 1-114622 | 5/1989 | Japan | 219/270 |

*Primary Examiner*—Teresa J. Walberg

*Attorney, Agent, or Firm*—Blakely, Sokoloff, Taylor & Zafman

[57] ABSTRACT

In a glow plug, a resistance element buried in an elongated, rod-like insulating ceramic member includes first and second resistive heating elements. The first heating element is arranged at the front end portion of a ceramic heater and made of a positive temperature coefficient resistive ceramic material, containing silicon nitride, such as SiAlON. The second heating element is arranged behind of and connected in series with the first heating element and made of a metal material (e.g., tungsten) having a positive temperature coefficient of resistance larger than that of the first heating element. Both heating elements are arranged in the portion of the ceramic member projecting outwardly from the holder and metal pipe fitted about the control portions of the ceramic member. The glow plug further comprises a metal holder holding the rod-like member in a way that a front portion of the rod-like member protrudes from the metal holder. The metal holder is substantially tubular and includes a metal pipe fitted on and fixed at a central portion in a longitudinal direction of the rod-like member, and is connected to the second heating element.

4 Claims, 2 Drawing Sheets

GLOW PLUG WITH DUAL, DISSIMILAR RESISTIVE HEATING ELEMENTS IN CERAMIC HEATER

This is a continuation of application Ser. No. 07/816,352 filed Dec. 30, 1991, now abandoned.

BACKGROUND OF THE INVENTION

The present invention relates to a glow plug used to preheat a sub combustion chamber or a combustion chamber of a diesel engine and, more particularly, to a self-temperature control glow plug of a ceramic heater type, which has a rapid heating property and a self-temperature control ability and can achieve afterglow over an extended period.

Of conventionally known diesel engine glow plugs having various structures, ceramic heater type glow plugs have recently attracted attention because, for example, they can function as rapid heating type glow plugs. U.S. Pat. No. 4,401,065 discloses an example of such a ceramic heater type glow plug using a ceramic heater in which a heating wire consisting of tungsten (W) or a rhenium alloy (Re) is buried in an insulating ceramic material. A glow plug of this ceramic heater type is superior in thermal conduction coefficient to a glow plug of a conventionally common sheath type. Therefore, a glow plug of this type improves its heating characteristic or temperature rise characteristic, thus acquiring performance as a rapid heating type. In such a glow plug with a ceramic heater, however, one type of heating wire is simply buried in the heater. Therefore, it is difficult to obtain, with this single heater element alone, a self-temperature control ability of controlling the heating characteristics of the heating wire such that a predetermined heating characteristic and a predetermined saturation temperature characteristic are obtained. As a result, a resistance wire or the like for power control must be additionally provided on a power supply circuit.

For this reason, U.S. Pat. No. 4,650,963, for example, has already proposed a glow plug in which in a metal holder constituting the glow plug, an auxiliary heater consisting of a metal sheath, which incorporates a resistance element capable of controlling power supply to a ceramic heater, is connected in series with the rear end of the ceramic heater.

In the glow plug having the above structure, however, it is necessary to use the sheath type auxiliary heater in addition to the ceramic heater. The results are an increase in the total number of parts and problems in the manufacture of the glow plug, which lead to a high cost. In addition, placing the sheath type auxiliary heater for power control in the metal holder of the glow plug increases the temperature inside the holder although the holder requires no temperature rise, resulting in a problem of mechanical strength against heat in individual parts. This inevitably poses problems such as wasteful power consumption as well as poor reliability.

Another ceramic heater structure is proposed in, e.g., Japanese Patent Laid-Open No. 58-10919, in which two types of metal wires with different positive temperature coefficients of resistance are connected in series with each other and buried in an insulating ceramic material. However, if silicon nitride, for example, is used as the insulating ceramic material in putting such a structure into practical use, it is difficult to select a metal wire having a positive temperature coefficient of resistance small enough to resist the sintering temperature of the material, approximately 1,800° C. Therefore, a consideration must also be given in this respect in adopting the above structure.

In particular, a glow plug of this type has been recently, strongly required to employ a so-called afterglow system. In this system, power supply to a glow plug is maintained for a predetermined time period after an engine is started, thus smoothly and properly performing a combustion inside the engine. In addition, it is required to increase this afterglow time as long as possible. In performing power supply control during afterglow, the conventional ceramic heater as described above has problems in durability such as mechanical strength against heat. A demand has therefore arisen for some countermeasure made in consideration of these problems and capable of achieving a function as rapid heating and a self-temperature control function, and simplifying the overall structure.

SUMMARY OF THE INVENTION

It is an object of the present invention to provide a ceramic heater type glow plug with a high resistance against high temperature and an improved reliability.

It is another object of the present invention to provide a ceramic heater type glow plug satisfactory in both a rapid heating function and a self-temperature control function.

It is still another object of the present invention to provide a ceramic heater type glow plug with a simplified overall structure.

In order to achieve the above objects of the present invention, there is provided a glow plug including a rod-like ceramic heater formed by burying a resistance element in an elongated rod-like member of insulating ceramic material, wherein the resistance element buried in the insulating ceramic material comprises a first heating element arranged at the front end portion of the rod-like ceramic member and made of a resistive ceramic material such as SiAlON, and a second heating element arranged behind and connected in series with the first heating element and made of a metal material, such as tungsten having a positive temperature coefficient of resistance larger than that of the first heating element, and the glow plug further includes a tubular metal holder holding the rod-like ceramic member, with the front end portion of the ceramic member projecting from the metal holder, wherein the first and second heating elements are substantially entirely buried in the portion of the rod-like ceramic member that projects from the metal holder, and wherein the metal holder includes a metal pipe fitted on and fixed at a central portion in a longitudinal direction of the rod-like ceramic member, with the second heating element connected, at the location where the metal pipe is fixed, to a lead portion buried in a rear end portion of the rod-like ceramic member.

DETAILED DESCRIPTION OF THE PREFERRED EMBODIMENT

Figure 1:
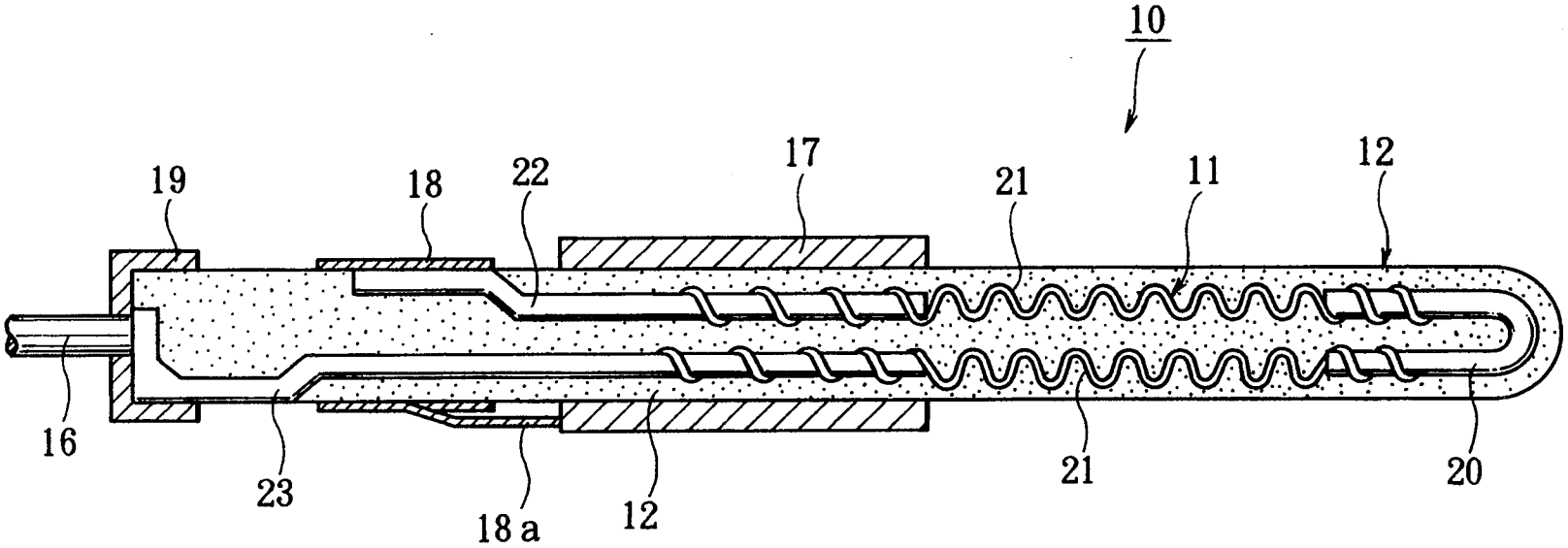
FIG. 1 is a schematic sectional view of an embodiment of a ceramic heater type glow plug according to the present invention, showing a ceramic heater portion as a main part in an enlarged scale.
Figure 2:
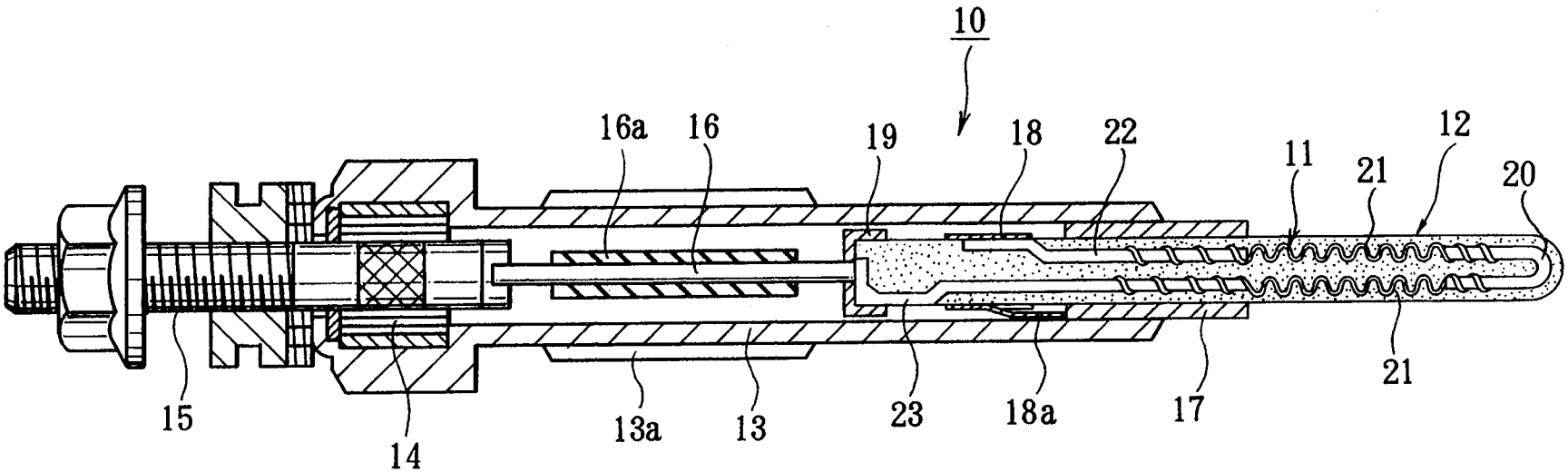
FIG. 2 is a schematic sectional view of the entire structure of the glow plug using the ceramic heater shown in FIG. 1.

FIGS. 1 and 2 show an embodiment of a ceramic heater type glow plug according to the present invention. First, the schematic arrangement of a glow plug generally denoted by reference numeral 10 will be briefly described below with reference to FIG. 2. The glow plug 10 comprises a resistance element 11 composed of two types of heating elements 20 and 21, a rod-like ceramic heater 12 with lead portions 22 and 23 buried in an elongated rod-like member 12A of insulating ceramic material consisting of, e.g., silicon nitride ($Si_3N_4$), and a substantially tubular metal holder 13 for holding the rod-like member 12A such that the heating front end portion of the rod-like member 12A projects from the front end portion of the holder 13. An external connection terminal 15 is fitted in and held by the rear end portion of the holder 13 via an insulating bush 14 consisting of, e.g., a synthetic resin. The inner end of the external connection terminal 15 is connected to the rear end portion of the ceramic rod-like member 12A via a metal conductor 16, such as a flexible wire. Note that reference numeral **16*a* denotes an insulating sleeve fitted on the metal conductor 16; and 13*a*, a threaded portion formed on the outer circumferential surface of the holder 13. The threaded portion 13*a* is threadably engaged with a screw hole of an engine cylinder head (not shown) such that the front end of the rod-like member 12A** projects into a sub combustion chamber (or a combustion chamber).

The ceramic rod-like member 12A has a substantially elliptic sectional shape and is formed by molding or sintering a ceramic powder which is filled in a metal mold with the resistance element 11 held in the mold, or by sintering under pressure a structure in which the resistance element 11 is sandwiched between the bonded surfaces of a pair of molded ceramic rods. In this case, the reason why the sectional shape of the ceramic rod-like member 12A is substantially an ellipse because an ellipse increases the density of a ceramic material as compared with a circle and in this manner achieves a high strength, a high insulation property, and a high thermal conductivity more effectively. However, the sectional shape of the ceramic rod-like member 12A is not limited to an ellipse. Preferable examples of the material of the ceramic rod-like member 12A are a silicon-based non-oxide excellent in an insulation property and a thermal conductivity, e.g., a silicon-based nitride such as silicon nitride.

Reference numeral 17 denotes a reinforcing metal pipe fitted on and fixed at the central portion in the longitudinal direction of the ceramic rod-like member 12A. The metal pipe 17 has an inner hole corresponding to the sectional shape of the rod-like member 12A, and is fixed by silver brazing using a metallized layer of nickel or the like formed on the outer circumferential portion of the rod-like member 12A. Note that reference numerals 18 and 19 denote terminal caps fitted, respectively, on a part of the central portion close to the rear end of the rod-like member 12A and on the rear end portion of the rod-like member 12A. The metal caps 18 and 19 are silver-brazed on these portions via metallized layers. The metal cap 18 is connected to the metal pipe 17 via a lead portion **18*a* and is grounded to the holder 13 by brazing or the like. The metal cap 19 is anode-connected to the metal conductor 16**.

According to the present invention, in the ceramic heater type glow plug 10 having the above arrangement, the first heating element 20 formed to have a substantially U-shape using resistive SiAlON as a resistive ceramic material is buried as the heating resistance element in the front end portion of the rod-like ceramic member 12A, as is apparent from FIGS. 1 and 2. In addition, the second heating elements 21 consisting of a metal, such as tungsten (W), which has a positive temperature coefficient of resistance larger than that of the first heating element 20, are buried as the power control resistance elements connected in series with both the end portions of the first heating element 20 at the rear end of the rod-like member 12A, thus constituting the ceramic rod-like member 12A.

In this case, as the resistive ceramic material which forms the first heating element 20, it is preferable to use SiAlON prepared such that the content of titanium nitride (TIN) as a resistivity imparting agent in $\beta$ SiAlON mainly consisting of silicon nitride ($Si_3N_4$) or SiAlON consisting of a phase mixture of $\alpha$ and $\beta$, is increased/decreased to arbitrarily select specific resistance. That is, it is confirmed that the SiAlON described above acquires resistivity (i.e., becomes so-called resistive SiAlON) when added with about 20% or more of TiN. It is also known that the specific resistance of the SiAlON continuously changes upon addition of TiN at a content exceeding the above value. Therefore, SiAlON having a TiN content selected from the above range may be arbitrarily used. In this case, the temperature coefficient of resistance of the resistive SiAlON is determined by the relationship between the TiN amount and the resistance ratio; that is, the positive temperature coefficient of resistance of the first heating element 20 consisting of the resistive SiAlON is set smaller than that of the second heating elements 21. The resistive ceramic material, however, is not limited to the resistive SiAlON described above but may be any ceramic material as long as the material is stable in performance even at a high temperature (e.g., up to about 1,200° C.) and has a temperature coefficient of resistance smaller than that of the second heating element 21 and a high resistance to thermal shock. A possible example of the ceramic material is a SiAlON sintered product containing at least one member selected from the group consisting of SiC and non-oxide resistive materials such as a carbide, a boride, a nitride, and a carbon nitride of Group 4*a*, 5*a*, and 6*a* elements of the periodic table, and Al or an Al compound as a sintering binder. In burying the first heating element 20 consisting of such a resistive ceramic material in the insulating ceramic material, the resistive ceramic material may be mixed directly in the form of a powder, or a molded resistive ceramic material may be buried.

The second heating elements 21 are preferably made of a tungsten (W) wire whose positive temperature coefficient of resistance can be set larger than that of the resistive SiAlON which forms the first heating element 20.

Note that reference numerals 22 and 23 denote lead portions extending from the rear end portion of the second heating elements 21 and connected to the terminal caps 18 and 19, respectively. The second heating elements 21 are connected to both the end portions of the first heating element 20 and the front end portions of the lead portions 22 and 23 while being wound around these end portions. The second heating elements 21 are also formed spirally in the longitudinal direction of the rod-like member 12A and buried in the heater 12. However, the connection method is not limited to this one, but a connection may be made by burying the second heating elements 21 in the resistive SiAlON for forming the first heating element 20. An arbitrary connection method may also be taken at the side of the lead portions 22 and 23 in accordance with the material of these portions. That is, in this embodiment, since wire members are exemplified as the lead portions 22 and 23, it is preferable to use a wire which consists of, e.g., tungsten and has a wire diameter much larger than that of the second heating elements 21.

According to the ceramic heater 12 having the above arrangement according to the present invention, in the initial stage of power supply, a high power is supplied to the first heating element 20 at the front end of the ceramic rod-like member 12A to cause the first heating element 20 to rapidly generate heat, thus achieving the performance as rapid heating. When a predetermined time has elapsed, the power supply to the first heating element 20 is controlled by the second heating elements 21 buried in the rear end of the ceramic rod-like member 12A and serving as power control resistance elements. As a result, long-time afterglow can be performed while the function as a rapid heating type is achieved.

In this embodiment, the first and second heating elements 20 and 21 are disposed in the ceramic so as to be located outward from the metal pipe 17 for holding these elements at the front end portion of the metal holder 13. Therefore, the bonded portion between the rod-like member 12A and the pipe 17 or between the terminal caps 18 and 19 is not adversely affected by the temperature rise in the heating elements 20 and 21. In addition, the heat conduction from the second heating elements 21 as power control resistance elements to the holder 13 through the pipe 17 is suppressed to obtain a desired heating condition, thereby achieving a power control function. This clearly indicates the advantage of the present invention.

According to this arrangement, the glow plug 10 of a self-temperature control type can be formed simply and inexpensively with a minimum necessary number of parts. In addition, since the heating portion at the front end of the ceramic rod-like member 12A consists of a ceramic material alone, the glow plug is excellent in mechanical strength against heat or durability and can therefore realize afterglow for a long time period. Furthermore, no wasteful power consumption is caused because only the ceramic portion generates heat, thus ensuring the reliability in mechanical strength against heat.

Note that in the above embodiment, the second heating elements 21 are made of a tungsten (W) wire whose positive temperature coefficient of resistance can be set larger than that of resistive SiAlON as the resistive ceramic material for forming the first heating element 20. However, the present invention is not limited to the above embodiment, but the second heating elements 21 can be made of a metal material, such as a tungsten alloy, whose positive temperature coefficient of resistance is larger enough to maintain the above relationship than that of the resistive ceramic material which forms the first heating element 20.

The present invention is not limited to the structure of the above embodiment, but it is possible to change or modify the shape, the structure, or the like of each part of the glow plug 10, and in this manner various modifications may be made.

As has been described above, according to the ceramic heater type glow plug of the present invention, the first heating element consisting of a resistive ceramic material is buried as a heating resistance element in the front end portion of the rod-like ceramic member 12A consisting of an insulating ceramic material. In addition, the second heating elements consisting of a metal material with a positive temperature coefficient of resistance larger than that of the first heating element are buried as power control resistance elements to be connected in series with the first heating element at the rear end portion of the rod-like member 12A, thus constituting the ceramic heater. Therefore, regardless of the simple and inexpensive structure of the heater, a high power is supplied to the first heating element at the front end of the ceramic heater to cause the first heating element to rapidly generate heat, thereby achieving the performance as rapid heating. When a predetermined time has elapsed, the power supply to the first heating element is controlled by the second heating elements buried in the rear end portion of the ceramic heater and serving as the power control resistance elements. Consequently, not only red heating can be rapidly obtained to achieve the function as rapid heating, but also appropriate saturation temperature characteristics can be obtained to achieve the function as self-temperature control. In addition, it is possible to perform afterglow over an extended period as a countermeasure against exhaust and noise of an engine.

In particular, according to the present invention, since the first heating element as a heating resistance element consists of a resistive ceramic material and hence is excellent in mechanical strength against heat, the durability of the heater is improved. This effectively achieves long-term afterglow. In addition, the glow plug generates heat only in the ceramic heater portion, so that no unnecessary heat is generated in the other portions and hence no wasteful power consumption is caused. Therefore, this glow plug is also excellent in reliability such as mechanical strength against heat.

What is claimed is:

1. A glow plug including a rod-like ceramic heater formed by burying a resistance element in an elongated rod-like member of insulating ceramic material, wherein said resistance element is buried in said insulating ceramic material comprises:

a first heating element arranged at a front end portion of said rod-like ceramic member, said first heating element being made of resistive SiAlON having a positive temperature coefficient set at a predetermined value;

a second heating element arranged behind and connected in series with said first heating element, said second heating element being made of tungsten, and having a positive temperature coefficient larger than the predetermined value of the positive temperature coefficient of said first heating element; and wherein said glow plug further includes:

a substantially tubular metal holder holding the rod-like ceramic member rearwardly of said first and second heating elements with the front end portion thereof projecting from said metal holder, wherein said first and second heating elements are substantially entirely buried in the portion of the rod-like ceramic member projecting from said metal holder, and wherein said metal holder includes a metal pipe fitted on, and fixed at, a central portion in a longitudinal direction of said rod-like ceramic member, with said second heating element connected, at the portion where said metal pipe is fixed, to a lead portion buried in a rear end portion of said rod-like ceramic member.

2. A plug according to claim 1, wherein said first heating element has a temperature coefficient set at a predetermined value by changing the specific resistance of said first element.

3. A plug according to claim 1, wherein said second heating element is formed spirally along the longitudinal direction of said rod-like ceramic member and connected to an end portion of said first heating element while being wound around the end portion.

4. A plug according to claim 1, wherein said second heating element is composed of a pair of heating wires connected to both end portions of said first heating element formed to have a U-shape.

* * * * *